US010697093B2

(12) United States Patent
Weis et al.

(10) Patent No.: US 10,697,093 B2
(45) Date of Patent: Jun. 30, 2020

(54) LINEAR TEXTILE STRUCTURE

(71) Applicant: Carl Freudenberg KG, Weinheim (DE)

(72) Inventors: Norbert Weis, Weinheim (DE); Diana Thyson, Bad Duerkheim (DE)

(73) Assignee: CARL FREUDENBERG KG, Weinheim (DE)

( * ) Notice: Subject to any disclaimer, the term of this patent is extended or adjusted under 35 U.S.C. 154(b) by 461 days.

(21) Appl. No.: 15/505,930

(22) PCT Filed: Aug. 19, 2015

(86) PCT No.: PCT/EP2015/069040

§ 371 (c)(1),
(2) Date: Feb. 23, 2017

(87) PCT Pub. No.: WO2016/030249

PCT Pub. Date: Mar. 3, 2016

(65) Prior Publication Data

US 2017/0260658 A1 Sep. 14, 2017

(30) Foreign Application Priority Data

Aug. 27, 2014 (DE) ..... 10 2014 012 492

(51) Int. Cl.

| | |
|---|---|
| ***A47L 13/20*** | (2006.01) |
| ***D02G 3/34*** | (2006.01) |
| ***D02G 3/38*** | (2006.01) |
| ***D04B 1/14*** | (2006.01) |

(52) U.S. Cl.

CPC ..... *D02G 3/38* (2013.01); *A47L 13/20* (2013.01); *D02G 3/346* (2013.01); *D04B 1/14* (2013.01)

(58) Field of Classification Search

CPC ..... A47L 13/20; D02G 3/38; D02G 3/346; D04B 1/14

USPC ..... 15/228, 229.1

See application file for complete search history.

(56) References Cited

U.S. PATENT DOCUMENTS

| | | | | |
|---|---|---|---|---|
| 4,903,366 | A * | 2/1990 | Traglia | A47L 13/144 15/119.1 |
| 6,131,233 | A * | 10/2000 | Bolton | A47L 13/20 15/229.1 |
| 7,749,600 | B1 | 7/2010 | Patrick et al. | |
| 7,866,138 | B2 | 1/2011 | Patrick et al. | |
| 2010/0263153 | A1 | 10/2010 | Patrick et al. | |
| 2013/0305788 | A1 | 11/2013 | Atmanspacher | |
| 2014/0230635 | A1 | 8/2014 | Gilmore et al. | |

FOREIGN PATENT DOCUMENTS

| | | | |
|---|---|---|---|
| CN | 202116777 | U | 1/2012 |
| DE | 102013101470 | A1 | 8/2014 |
| EP | 2664699 | A1 | 11/2013 |

(Continued)

*Primary Examiner* — Randall E Chin

(74) *Attorney, Agent, or Firm* — Leydig, Voit & Mayer, Ltd.

(57) ABSTRACT

A linear textile structure has at least two strands, wherein a first strand has microfibers and a second strand encloses the first strand, wherein the structure may provide a stable linear textile structure, by which the most effective cleaning possible can be achieved with minimum effort. Both strands can be brought into contact together at least in some sections and simultaneously with a surface to be cleaned.

24 Claims, 3 Drawing Sheets

(56) References Cited

FOREIGN PATENT DOCUMENTS

| | | | | |
|---|---|---|---|---|
| JP | S 9748323 | A | | 10/1984 |
| JP | H 03260135 | A | | 11/1991 |
| JP | 2001159051 | A | | 6/2001 |
| JP | 2005240190 | A | | 9/2005 |
| JP | 2010099268 | A | | 5/2010 |
| WO | WO 9748323 | A1 | | 12/1997 |
| WO | WO 00/58092 | | * | 10/2000 |

* cited by examiner

LINEAR TEXTILE STRUCTURE

CROSS-REFERENCE TO RELATED APPLICATIONS

This application is a U.S. national stage application under 35 U.S.C. § 371 of International Application No. PCT/EP2015/069040, filed on Aug. 19, 2015, and claims benefit to German Patent Application No. DE 10 2014 012 492.4, filed on Aug. 27, 2014. The International Application was published in German on Mar. 3, 2016, as WO 2016/030249 A1 under PCT Article 21(2).

FIELD

The invention relates to a linear textile structure.

BACKGROUND

Linear textile structures in which the core contains an inner, first strand made of microfibers and at least one additional strand made of other fibers loops around said first strand are already known from the prior art, in particular US 2010/026 31 53 A1, U.S. Pat. No. 7,866,138 B2 or U.S. Pat. No. 7,749,600 B1.

It is known that the microfiber core in the interior of a linear structure is designed such that said structure is completely covered with one or more additional strands for the purpose of stabilization, and therefore the desired functions of the microfibers, such as absorption of liquids or an improvement in cleaning performance, can only be implemented indirectly and thus are less effective. In this process, the microfibers do not have any direct contact with an outer or external surface.

Simpler linear textile structures which continuously consist of microfibers themselves have the drawback of being less durable when used on rough surfaces, since the microfibers easily catch in irregularities and are pulled out of the yarn.

In addition, the friction of these structures when in contact with a surface is very high, particularly when moist, due to the large direct contact surface area, the high coefficient of friction and the high weight of the fully saturated microfibers.

This is a drawback when wiping surfaces using cleaning devices made from structures of this type due to the high amount of force required. In addition, these structures do not provide satisfactory cleaning performance when used on stubborn dirt on surfaces due to the softness of the fibers of said structures.

SUMMARY

A aspect of the invention provides a linear textile structure, comprising: a first strand including a microfiber; and a second strand, surrounding the first strand, wherein the two strands are configured be brought into contact with a surface to be cleaned, jointly and simultaneously at least in regions.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
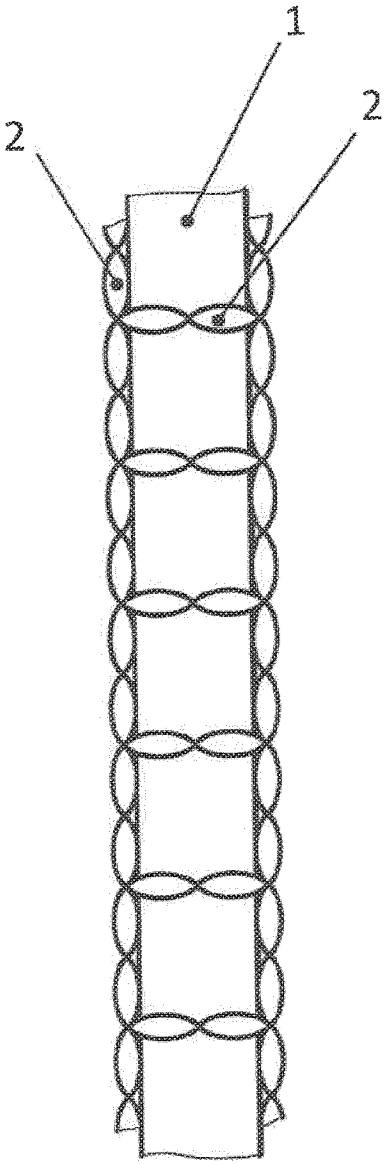
FIG. 1 shows a first strand which comprises microfibers and around which a second strand made of two intermeshed yarns in the form of a ladder yarn loops.

Against this background, a problem addressed by an aspect of the invention is to provide a stable linear textile structure which can produce the most effective cleaning possible together with a low amount of force being required.

According to an aspect of the invention, it has been acknowledged that appropriately arranging various strands makes it possible to design the inner strand as an actively usable part of the structure as a whole. At the same time, the inner strand is also stabilized by the outer strand. The linear textile structure is designed such that a certain number of threads in a first strand are brought together and are held together by a certain number of one or more additional strands.

When wiped over an external surface, the outer second strand supports the textile structure partially on the surface and thus reduces the contact force and contact surface of the microfiber core, which has high friction and is heavy particularly when moist, and so reduces the friction on the surface. Because the support is only partial, the good properties of the microfibers to absorb water and fatty deposits also take effect. Here, the outer strand simultaneously has a more abrasive effect on dirt on the surface than the microfiber core alone.

By combining the softer, high-absorption first strand with a friction-modifying, abrasive second strand, and by having the core material exposed in regions, the durability as well as the softness and cleaning activity of the textile structure are achieved.

This solves one or more of the problems mentioned at the outset.

The second strand only covers part of the surface of the first strand when it surrounds the first strand. The strands are separate bodies that are suitable for looping around, but do not combine to form island-in-the-sea fibers or core-sheath fibers.

The second strand may have coarser fibers than the first strand. Owing to this design of the at least two strands and to the first strand being exposed in part, there can be optimal compatibility between the functionality of an open microfiber strand and the additional strands. Here, the coarser fibers are more stable and provide better support when used on a surface.

The second strand may be more abrasive than the first strand. As a result, improved cleaning performance when used on stubborn dirt can be achieved.

The relative abrasiveness of the individual strands can be determined by comparatively establishing the capacity for removing material from suitable surfaces using test samples in the form of textile fabrics made of the respective strand materials, for example woven cloths. An abrasion tester from BYK-Gardner GmbH or similar devices on which tests according to DIN ISO 11998 can be carried out may be used for this purpose.

In this process, the fabrics are moved back and forth (wiping cycles) side by side over test plates, each being loaded with the same weight, until approximately 75% of the coating applied to the test plates is removed at least by one test item.

The removal is analyzed visually, a comparison being made as to which of the test items has removed the coating over a larger surface area and therefore has higher abrasiveness within the meaning of the description.

Alternatively, the number of wiping cycles required for comparable removal of the coating can also be determined. The lower the number of wiping cycles required, the higher the abrasiveness of the strand material.

The test plates can be coated as described in the following in the "IKW Recommendation for the Quality Assessment of the Cleaning Performance of Cleaners for Glass Ceramic Cooking Fields", SÖFW Journal, 130, 11-2004:

"4.2. Setting Up the Experiments 4.2.1 Pre-Cleaning of the Plates

The glass ceramic cooking fields are cleaned by intensive brushing with an undiluted alkali cleaner (ca. pH 10) and subsequently with an undiluted hand dishwashing liquid detergent. The plates are then left for 2 h in a hot cleaning solution at a temperature of 50-60° C., consisting of a concentrated hand dishwashing liquid detergent (approx. 2%) and a descaler liquid (approx. 8%). Finally, using a chlorine-containing cleaner, two rinsing processes take place at 85° C. in a laboratory dishwasher operated with de-ionized water (overall time about 45 minutes per washing process).

4.2.2 Preparation and Application of Soiling, Burn-in Duration

Soiling must be always prepared freshly and applied to the tiles just after preparation. The soiled surface on one test plate is 30×9 cm (Sketch 1). The edges of the surface to be soiled are marked with a felt pen and then taped off with packing tape. The corresponding quantity of soiling is applied and equally spread with a spiral wiper (for "tomato" soiling) or a film spreader (for the other soiling types), removing the superfluous soiling from the plate. The soiling dries overnight at room temperature before the packing tape is removed without any residues by simply pulling it off. The soiling types are burnt in, using a preheated ambient-air ventilated warming cabinet at 200° C. and 240° C. for rice starch respectively; temperatures on the different grilles should not deviate from the standard temperature by more than 10° C.

The plates are placed individually next to each other on the grilles, with small marble blocks being placed underneath the plates. Before doing a comparative assessment, it needs to be evaluated whether and to what extent the position of plates during the burning process in the warming cabinet or the position of the track on the plates affects how easily the soiling can be removed. After cooling down to room temperature the plates can be stored upright in the laboratory for up to 10 days."

TABLE 1

Soiling and burn-in conditions

| Soiling | Preparation | Burn-in temperature | Burn-in duration |
|---|---|---|---|
| Gravy | Knorr ® Bratensauce aus der Tube ("gravy from the tube") (EAN 4038700101150) 33.3% suspension boiled in water Quantity applied per plate: 15 g Layer thickness(1): 200 μm | 200 ± 10° C. | 15 min |

TABLE 1-continued

Soiling and burn-in conditions

| Soiling | Preparation | Burn-in temperature | Burn-in duration |
|---|---|---|---|
| Strained tomatoes | Strained tomatoes (7%) (Manufacturer Play, EAN 8002700472059) Quantity applied per plate: 15 ml Layer thickness(1): 200 μm | 200 ± 10° C. | 13 min |
| Clotted cream/ Canned milk | Kleefeld ®-Schmand (»clotted cream«) 24% fat (EAN 4388440030044) Bärenmarke ®, Die Ergiebige(2) (»canned milk«) 10% fat (EAN 400550081012) Quantity applied per plate: 15 g clotted cream/7.5 g canned milk Layer thickness(1): 25 μm | 200 ± 10° C. | 15 min |
| Lime/ starch | 4% rice starch in salt water (20 +/− 4° dH (3), e.g. tap water) see Annex 1 Quantity applied per plate: 10 ml of the suspension Layer thickness(1): 25 μm | 240 ± 10° C. | 30 min |

(1)The quoted ayer thickness merely describes the nominal layer thickness of the wiper and the film spreader respectively. The thickness of the applied film results from the nominal layer thickness and the thickness of the adhesive tape. The layer thickness of the applied soiling after drying was not determined.

(2)The sub-brand name "Die Ergiebige" means "high-yield"

(3) The abbreviation "dH" stands for water hardness in Germany (1° dH = 10.00 mg/l CaO or 7.19 mg/l MgO)

The second strand may have lower friction on a surface than the first strand. As a result, the amount of force required to move a cleaning device equipped with the textile structures is reduced.

The relative friction of the individual strands can be determined by establishing the adhesion coefficient (μs) and sliding friction coefficient (μk) of test samples in the form of textile fabrics made of the respective strand materials, for example woven cloths, on a PVC floor covering or on floor tiles.

The overall resulting friction (the coefficient of friction) of the textile structures according to an aspect of the invention in the form of a combination of the microfiber core with differently designed second strands that loop around can also be determined.

The fibers in the second strand may have a titer of >1 dtex. It has been demonstrated that the stabilizing properties of such fibers in the linear structures are particularly pronounced.

The fibers in the second strand may preferably have a titer of greater than 1 dtex and less than 10 dtex. This means that it is easier to use commercially available machines or to carry out further processing thereon. It is also possible to provide improved compatibility with the floor using a plurality of individual fibers of this tex. This means that the abrasiveness can be better adjusted by using a plurality of thinner, slightly abrasive fibers rather than one thicker, highly abrasive fiber. This would also improve the distribution and the contact points with the floor. A plurality of individual fibers provide more contact points than one thick fiber.

The fibers in the second strand may have a titer of between 10 dtex and 100 dtex. The slightly abrasive material may preferably have individual degrees of fibre tex of between 10 dtex and 70 dtex in order to optimally facilitate the cleaning performance and to render the friction arising compatible with a surface to be cleaned. At the same time, the material has the required tex in order to be processed together with the microfiber yarn.

The titers describe the titers of the individual fibers of which the strands consist.

The second strand may comprise fibers having a non-round cross section. This improves the cleaning performance, since dirt can be better removed from surfaces.

The second strand may be designed as a planar and two-dimensional thread, preferably as a strip. The slightly abrasive material may also be ribbon-like or may be designed as a monofilament in order to promote the abrasive action.

The second strand may be antibacterial at least in regions. This can provide a hygienic effect for the textile structure as a whole, without the entire microfiber core needing to be rendered antibacterial in this manner.

The second strand may comprise a staple fiber yarn or a monofilament.

The second strand may be a different color from the first strand. The strands used may be different colors in order to also visually display a property to the user.

The second strand may be designed as a ladder yarn. This can surround even a relatively unstable, loose microfiber strand in the core particularly well.

The second strand may comprise two threads, which are interconnected to form a ladder yarn comprising chain stitches and tie-in loops, the first strand being guided through the tie-in loops at least in regions.

The second strand may comprise two threads that are wound around the first strand in opposite directions and lie on top of each other at points of intersection in the process. This results in good stabilization of the textile structure and does not produce a tendency for the textile structures to twist under one another, as can occur for winding in the same direction. In addition, the points of intersection form particularly pronounced support points owing to the threads lying on top of each other.

At least one thread may be designed as a melt thread. An abrasive yarn may be fused together at points in order to stabilize the structure.

The first strand may be designed as a yarn. This makes it easier to produce the textile structure in an effective manner.

The first strand may be made exclusively of microfibers. This means that the special absorption and grease-removing properties of an accordingly designed cleaning device are particularly pronounced.

At least one additional strand or additional strands may be provided in addition to the first strand, the first strand and the additional strand or additional strands being surrounded by the second strand. The additional strand or additional strands may not comprise any microfibers. The additional strand or additional strands may comprise abrasive fibers, such that said additional strand or additional strands is/are more abrasive than the second strand. This further improves the cleaning action.

Said linear textile structure may for example be produced on specially designed knitting machines, e.g. on a circular knitting machine or a crochet galloon machine. This mode of production makes it possible to use a wide range of strand materials and provides particularly good stabilization and surface structuring of the textile fabric, and can produce e.g. longitudinal sections resembling a string of pearls and/or round, flat, triangular or rectangular cross sections. Owing to the intermeshing, the second strand is also already largely stable in itself. This makes it possible to cut textile fabrics to length and to process said fabrics into products without there needing to be additional end stabilization at the cutting points.

A mop head for arranging on a cleaning device may comprise a main body from which structures of the type described here project or hang by a free end or in the form of loops.

The textile cleaning products described here are for domestic and professional use.

FIG. 1 shows a linear textile structure, comprising at least two strands 1, 2, a first strand 1 comprising microfibers and a second strand 2 surrounding the first strand 1.

The two strands 1, 2 can be brought into contact with a surface to be cleaned jointly and simultaneously at least in regions.

The second strand 2 only covers part of the surface of the first strand 1 when it surrounds the first strand 1.

The second strand 2 has coarser fibers than the first strand 1. The second strand 2 is more abrasive than the first strand 1. The second strand 2 has lower friction on a surface than the first strand 1. The structure has lower friction on a surface than the first strand 1 alone.

The fibers in the second strand 2 have a titer of >1 dtex. The fibers in the second strand 2 have a titer of between 10 dtex and 100 dtex.

The second strand 2 comprises fibers having a non-round cross section. The second strand 2 is antibacterial at least in regions. The second strand 2 comprises a staple fiber yarn or a monofilament.

The second strand 2 is a different color from the first strand 1.

The second strand 2 is designed as a ladder yarn. FIG. 1 schematically shows a first strand 1 which comprises microfibers and around which a second strand 2 made of two intermeshed yarns in the form of a ladder yarn loops.

The first strand 1 is made exclusively of microfibers.

The structure is characterized by production by means of a knitting machine.

Figure 2:
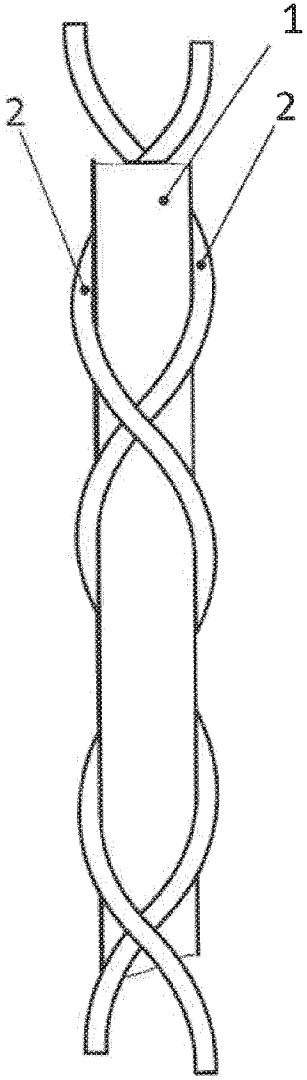
FIG. 2 shows an embodiment in which two threads of the second strand wound in opposite directions loop around the first strand.

FIG. 2 shows an embodiment in which two threads of the second strand 2 wound in opposite directions loop around the first strand 1. The second strand 2 comprises two threads, which are wound around the first strand 1 in opposite directions and lie on top of each other at points of intersection in the process.

Figure 3:
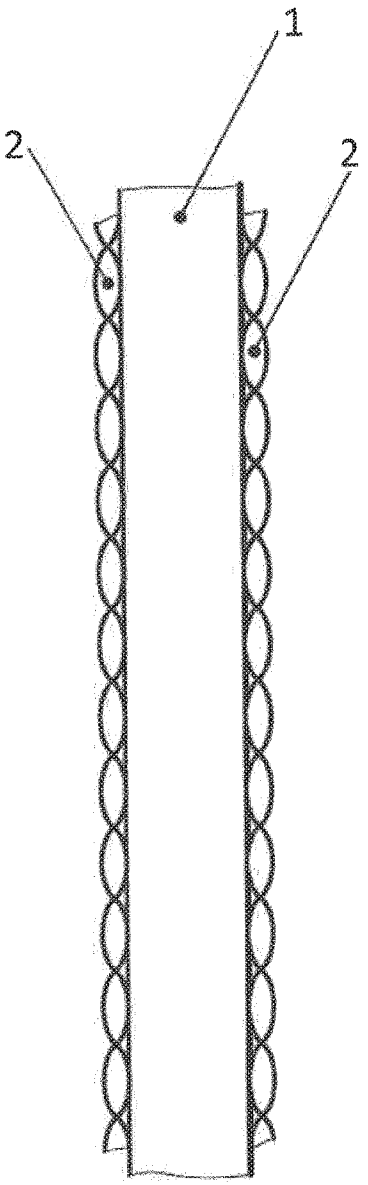
FIG. 3 shows an embodiment in which the first strand is surrounded by the second strand formed by two intermeshed yarns.

FIG. 3 shows an embodiment in which the first strand 1 is surrounded by the second strand 2 formed by two intermeshed yarns.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A linear textile structure, comprising:

a first strand including a microfiber; and a second strand, surrounding the first strand, wherein the two strands are configured to be brought into contact with a surface to be cleaned, jointly and simultaneously at least in regions, and wherein the second strand is more abrasive than the first strand.

2. The structure of claim 1, wherein the second strand only covers part of a surface of the first strand when surrounding the first strand.

3. The structure of claim 1, wherein the second strand includes coarser fibers than the first strand.

4. The structure of claim 1, wherein the second strand has lower friction on a surface than the first strand.

5. The structure of claim 1, having lower friction on a surface than the first strand alone.

6. The structure of claim 1, wherein fibers in the second strand have a titer of >1 dtex.

7. The structure of claim 1, wherein fibers in the second strand have a titer in a range of from 10 dtex to 100 dtex.

8. The structure of claim 1, wherein the second strand includes fibers having a non-round cross section.

9. The structure of claim 1, wherein the second strand is a planar and two-dimensional thread.

10. The structure of claim 1, wherein the second strand is antibacterial at least in regions.

11. The structure of claim 1, wherein the second strand includes a staple fiber yam or a monofilament.

12. The structure of claim 1, wherein the second strand is a different color from the first strand.

13. The structure of claim 1, wherein the second strand is designed as a ladder yam.

14. The structure of claim 13, wherein the second strand includes a first thread and a second thread, wherein the first and second threads are interconnected to form a ladder yarn including chain stitches and tie-in loops, and wherein the first strand is guided through the tie-in loops at least in regions.

15. The structure of claim 1, wherein the second strand includes a first thread and a second thread, and wherein the first and second threads are wound around the first strand in opposite directions and lie on top of each other at points of intersection.

16. The structure of claim 15, wherein at least one thread is a melt thread.

17. The structure of claim 1, wherein the first strand is a yarn.

18. The structure of claim 1, wherein the first strand is made exclusively of microfibers.

19. The structure of claim 1, further comprising:

a third strand, wherein the first strand and the third strand is surrounded by the second strand.

20. The structure of claim 1, produced by a process comprising knitting.

21. The structure of claim 1, produced by a process comprising knitting using a circular knitting machine.

22. The structure of claim 1, produced by a crochet galloon machine.

23. A mop head for arranging on a cleaning device, the mop head comprising:

a main body including the structure of claim 1, wherein the structure is configured to project or hang by a free end or in the form of loops from the mop head.

24. A linear textile structure, comprising:

a first strand including a microfiber; and a second strand, surrounding the first strand, wherein the two strands are configured to be brought into contact with a surface to be cleaned, jointly and simultaneously at least in regions, and wherein the second strand is designed as a ladder yarn.

* * * * *